United States Patent [19]

Zapf

[11] 4,285,544

[45] Aug. 25, 1981

[54] FURNITURE CONSTRUCTION

[75] Inventor: Otto W. Zapf, Eschborn, Fed. Rep. of Germany

[73] Assignee: Knoll International, Inc., Greenwich, Conn.

[21] Appl. No.: 796,311

[22] Filed: May 12, 1977

Related U.S. Application Data

[63] Continuation of Ser. No. 633,410, Nov. 19, 1975, abandoned, which is a continuation of Ser. No. 480,295, Jun. 17, 1974, abandoned, which is a continuation-in-part of Ser. No. 363,798, May 25, 1973, abandoned.

[30] Foreign Application Priority Data

| | | | |
|---|---|---|---|
| May 31, 1972 | [DE] | Fed. Rep. of Germany | 7220445 |
| Jun. 13, 1972 | [DE] | Fed. Rep. of Germany | 7222086 |
| Jul. 22, 1972 | [DE] | Fed. Rep. of Germany | 7227236 |
| Oct. 24, 1972 | [DE] | Fed. Rep. of Germany | 7238927 |

[51] Int. Cl.[2] ..... A47C 1/12

[52] U.S. Cl. ..... 297/440; 5/462; 5/470; 297/DIG. 6; 297/218

[58] Field of Search ..... 297/219, DIG. 6, 440, 297/445, 452, 455, 456, 457, 460; 5/337, 339

[56] References Cited

U.S. PATENT DOCUMENTS

| | | | |
|---|---|---|---|
| 1,939,834 | 12/1933 | Sher | 297/455 |
| 2,567,579 | 9/1951 | Russell | 297/218 |
| 2,837,144 | 6/1958 | Heller | 297/456 X |
| 2,853,124 | 9/1958 | Shapiro | 297/456 |
| 2,962,731 | 12/1960 | Bounds | 5/337 |
| 2,989,112 | 6/1961 | Sonnleitner | 297/DIG. 1 |
| 3,220,767 | 11/1965 | Hendrickson | 297/DIG. 6 |
| 3,308,490 | 3/1967 | Cacioppo | 5/345 R |
| 3,519,308 | 7/1970 | Kasman et al. | 297/460 X |
| 3,851,920 | 12/1974 | Harris et al. | 297/455 |

*Primary Examiner*—Ramon S. Britts
*Assistant Examiner*—Peter A. Aschenbrenner
*Attorney, Agent, or Firm*—Robert Scobey

[57] ABSTRACT

Furniture including a cushion comprising padding material, and upholstery material covering the padding material and releasably secured thereto. Such construction may advantageously be utilized for forming a cushion essentially in the form of an open-ended bag which is slipped over a cushion-receiving part of a frame for an item of furniture. The frame may include a base pan which is covered by padding material in turn covered by upholstery material. The upholstery material includes flaps releasably joined together on the underside of the base pan, and at least part of the upholstery material on the underside of the base pan is releasably secured to the base pan.

7 Claims, 6 Drawing Figures

FIG. 1
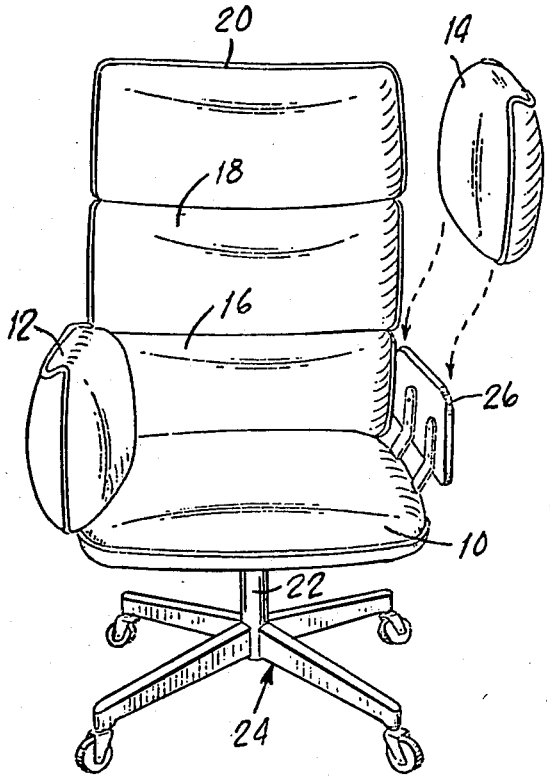
FIG. 2
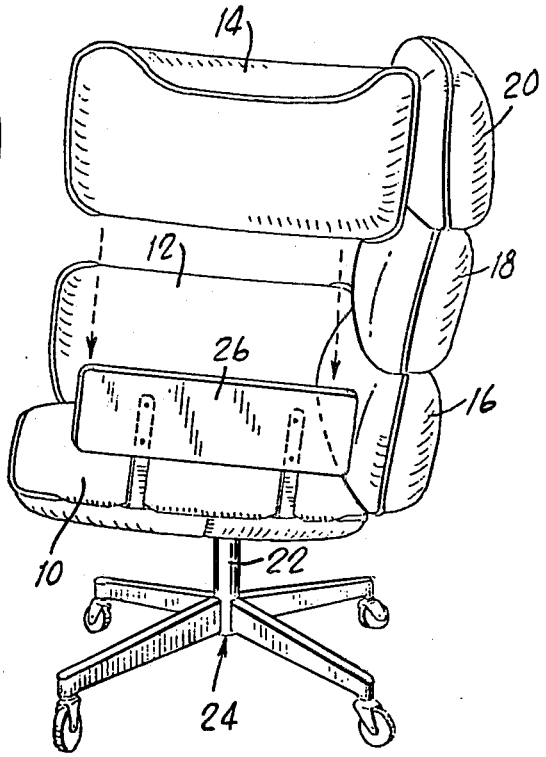
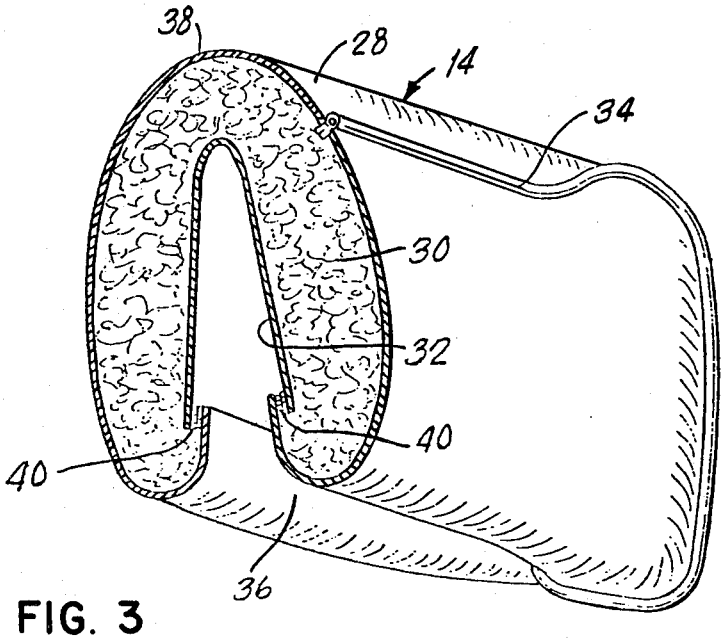
FIG. 3

FIG. 4
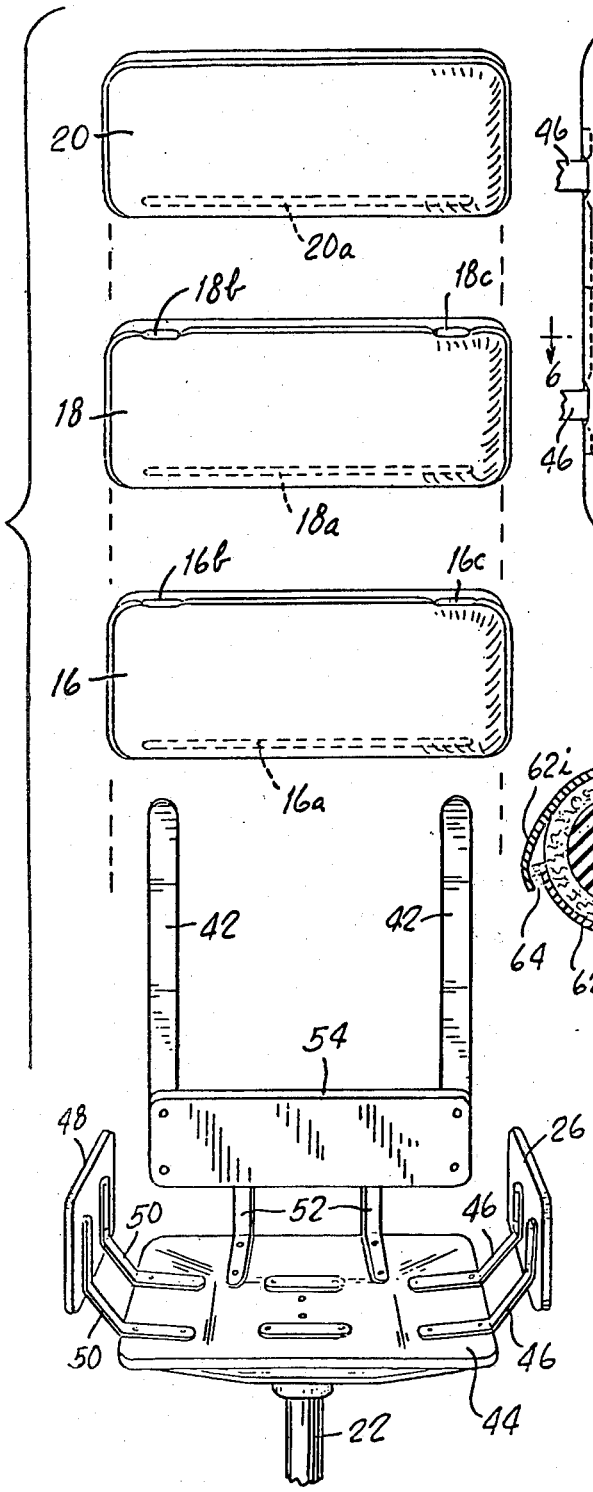
FIG. 5
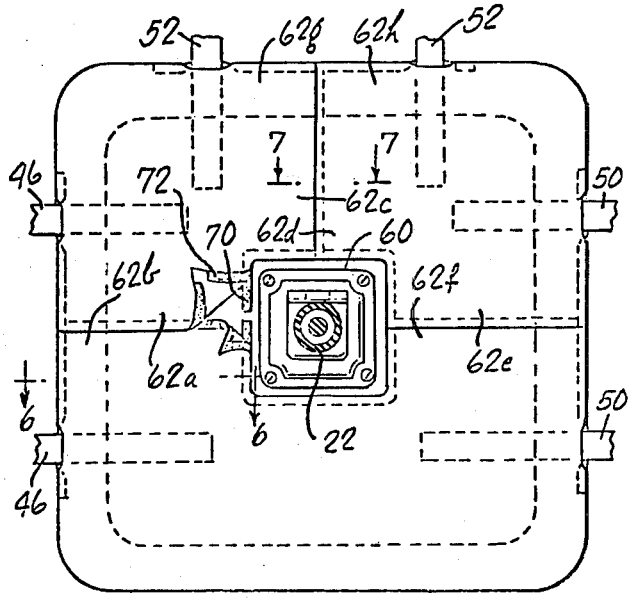
FIG. 6
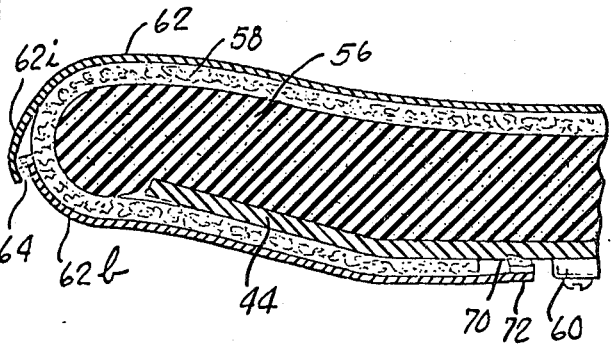
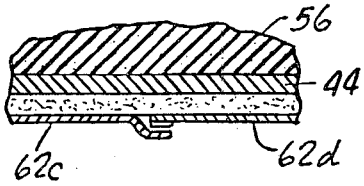
FIG. 7

FURNITURE CONSTRUCTION

CROSS REFERENCE TO RELATED APPLICATION

This is a continuation of application Ser. No. 633,410 filed on Nov. 19, 1975, now abandoned, which was a continuation of application Ser. No. 480,295 filed on June 17, 1974, now abandoned, which was a continuation-in-part of application Ser. No. 363,798 filed on May 25, 1973, now abandoned.

BACKGROUND AND BRIEF DESCRIPTION OF THE INVENTION

This invention relates to furniture construction, and more particularly to a unique chair or similar article fabricated from easily assembled and easily removed cushioning.

The present invention utilizes a base pan of a chair or similar article which is covered with padding material. Upholstery material covers the padding material and is formed with flaps that are releasably joined together on the underside of the base pan after the upholstery material is positioned in place over the padding material on the base pan. Selected parts of the upholstery material on the underside of the base pan are releasable secured to adjacent parts of the base pan to secure the entire cushion assembly to the base pan.

The base pan advantageously includes one or more upwardly extending cushion-receiving frame members. One or more cushions having openings therein to removably receive the cushion-receiving frame parts are utilized.

In this fashion a chair can be simply constructed with removable cushions that simply slip into place over frame parts, in combination with a uniquely upholstered base pan to which a part of an upholstery covering is releasably secured.

The cushions that receive the upwardly extending frame parts are advantageously formed from upholstery material that covers one surface of a padding material and which is releasably secured to an opposite surface of the padding material for ease in removing the upholstery material for cleaning.

The invention finds particular application with frame members of the type disclosed in my copending application Ser. No. 363,798 filed May 25, 1973, identified above.

In the prior art, cushions having openings therein for securing frame parts are known. See U.S. Pat. No. to Briggs 3,680,918 issued Aug. 1, 1972. Neither the unique releasable securing of upholstery material to padding nor the upholstering of a base pan as described above is disclosed or suggested in this patent.

The invention will be better understood by reference to the following detailed description, to be read in conjunction with the appended drawings.

BRIEF DESCRIPTION OF THE DRAWINGS

FIG. 1 is a front view of a chair embodying the present invention.

FIG. 2 is a side view of the chair of FIG. 1.

FIG. 3 is a perspective view of a cushion, severed in half, embodying the present invention.

FIG. 4 is an exploded view of the chair of FIG. 1 showing the details of its construction.

FIG. 5 is a bottom view of the chair of FIG. 1.

FIGS. 6 and 7 are sectional views taken from FIG. 5.

DETAILED DESCRIPTION OF THE DRAWINGS

FIG. 1 shows a chair embodying the invention. The chair includes a base cushion 10, side cushions 12 and 14, and rear cushions 16, 18 and 20. The number of cushions is simply representative and chosen for illustration only. The chair may include a conventional pedestal 22 and leg structure 24.

The side cushions 12 and 14 as well as the rear cushions 16, 18 and 20 simply slide into place over corresponding frame parts to be described in more detail below. FIG. 2 shows how the side cushion 14, for example, slides over frame part 26 that constitutes an upwardly extending cushion-receiving part of the chair frame, to be described in more detail below.

The cushion construction is shown in FIG. 3. The cushion 14 includes an outer upholstery material 28 and an inner padding material 30. The padding material 30 may be of synthetic material, such as "Dacron" batting, for example, which is faced with a facing 32 which also may be of synthetic material, such as "Dacron", for example. The padding material 30 and facing 32 together constitute a padding member. A conventional welting 34 may be included for decorative purposes.

The cushion in FIG. 3 essentially constitutes a bag, open at a first end 36 thereof and closed at a second opposite end 38. The upholstery covering 28 is releasably secured to the facing 32 of the padding by means of hook and loop type fasteners, such as "Velcro" for example, and designated 40 in FIG. 3. These releasable fastening members (male and female) are secured one to facing 32 and the other to the upholstery material 28 all along the open bag end. By this technique the upholstery material is secured to the batting, thereby completing the cushion with its open end 36 which may be easily slipped over the frame member 26.

The cushion construction shown in FIG. 3 has a number of advantages. First, all sewing required is essentially "flat" or so-called two-dimensional. Sewing of surfaces of compound curvature is not required, and all sewing may be done by a sewing machine. The batting 30 and facing 32 are easily inserted into the upholstery material 28 and removed therefrom should cleaning be necessary. All that is required to complete the assembly once the batting and facing are inserted is to attach the releasable fasteners 40 together. To provide for upholstery cleaning, the releasable fasteners are disattached from each other, and the padding constituted by batting 30 and facing 32 is easily removed.

FIG. 4 shows the three cushions 16, 18 and 20 in position just prior to assembly of the chair or just following disassembly. Note that all three cushions have openings designated **16*a*, 18*a* and 20*a* corresponding to the opening 36 of the cushion 14 shown in FIG. 3. The two intermediary cushions 16 and 18 include openings 16*b*, 16*c* and 18*b*, 18*c* for the purpose of permitting upwardly extending frame strips 42 to pass therethrough. The cushion 20 is identical, except that it does not include top openings such as the openings 16*b*, 16*c* and 18*b*, 18*c***.

In this regard, while the cushion constructions of FIG. 3 involve upholstery material releasably secured to padding material, the upholstery material could itself be releasably secured in various parts thereof to various other parts thereof. Thus the openings **16*a* and 18*a*** might be sealed together by the use of hook and loop type fasteners (not shown) on opposite sides of the opening to aid in maintaining the cushion in place.

In FIG. 4 the basic framework of the chair is simple. A base pan 44 is supported by the pedestal 22. Strips of metal, for example, designated 46 are attached to the base pan and support the upwardly extending, cushion-receiving part 26. A similar part 48 is secured to the base pan by straps 50. The straps 46 and 50 may be secured to the base pan 44 by any suitable means such as nuts and bolts, for example, with the bolts passing through the base pan. Straps 52 also attached to the base pan support rear frame part 54 to which are secured the upwardly extending rear straps 42 referred to above.

As noted above, the frame construction of the chair is extremely simple. Cushions cover all the upwardly extending frame parts that constitute cushion-receiving members. The base pan 44 is itself upholstered in simple fashion as shown in FIGS. 5 to 7. With reference to FIG. 6, the base pan 44 is covered by padding material 56. Another distinct padding layer 58 covers the padding material 56 and extends underneath the base pan 44 as well for the purpose of cushioning the nuts or other fastener that may be exposed on the underside of the base pan and which are used for attaching the straps 46, 50 and 52 to the base pan. The padding layer 58 typically surrounds base plate 60 that forms a part of the pedestal structure 22 and which is secured to the base pan 44 (FIG. 5). The padding layer 58 is covered by upholstery material 62. The upholstery material 62 is sewn flat in conventional fashion to form a cover for a cushion, except that it is provided with flaps **62*a* and 62*b*, 62*c* and 62*d*, 62*e* and 62*f*, and 62*g* and 62*h* which releasably mate together (for example by the use of male and female velcro fasteners). These flaps provide for the conventional slipping of the upholstery material over the padding material and about the base pan 44 and straps 46, 50 and 52. Between the straps (e.g., between the straps 46), adjacent parts of the cover (e.g., parts 62*b* and 62*i* in FIG. 6) are releasably joined together by use of velcro fasteners 64**, e.g.

Additionally, the underside of the base pan 44 includes a releasable fastening device 70 such as a hook and loop type fastener (male or female). A corresponding mating releasable fastener 72 is included on the adjacent portion of the upholstery cover 62. In this fashion the upholstery material is itself secured to the base pan 44 to aid in the securing of the cushion in place. Note that advantageously the releasable fasteners member 70 surrounds the base plate 60 of the pedestal assembly (see FIGS. 5 and 6)

It will be evident that furniture construction has been described in terms of presently preferred embodiments of my invention which provide for the rapid assembly and disassembly of a chair, for example. The specific embodiments described are, of course, susceptible to modification. Accordingly, the invention should be taken to be defined by the following claims.

What is claimed is:

1. Cushion construction comprising a resilient padding member in the general shape of a bag open at one of its ends and closed at its opposite end, upholstery material covering said padding member and also in the general shape of a bag open at one of its ends and closed at its opposite end and closed along its sides, said upholstery material enclosing said padding member with the open end of each adjacent each other, and the open end of said upholstery material extending inside the open end of said padding member, first attaching means along an inwardly exposed under surface of said upholstery material at the open end thereof, second attaching means along an inside surface of said padding member at and inside the open end thereof and removably attached to said first attaching means to provide an upholstered cushion in the general shape of a padded bag open at one of its ends and closed at its opposite end and closed along its sides and in which the upholstery material may be readily removed.

2. Cushion construction according to claim 1 in which said first and second attaching means comprise male and female hook and loop type fasteners secured one to said padding member and the other to said upholstery material along the open end of each.

3. A chair or similar construction upholstered with easily removable material comprising a base pan, padding material removably covering all of both sides of said base pan except for a limited area on one side of said base pan to which a base pan support structure is secured, and upholstery material removably covering all of said padding material on both sides of said base pan and formed with integral flaps of upholstery material releasably joined together on said one side of said base pan, and means releasably securing at least part of said upholstery material on said one side of said base pan to said base pan along an edge portion of said limited area of said base pan.

4. Furniture construction according to claim 3 in which said releasably securing means comprises male and female hook and loop type fasteners attached one to selected parts of said upholstery material on the underside of said base pan and the other to adjacent parts of said base pan along said edge portion of said limited area of said base pan.

5. A finished chair comprising a frame having a seat pan and a pair of upwardly extending cushion-receiving side arm structures and an upwardly extending cushion-receiving back support structure and a seat pan support structure, a plurality of cushion members removably fitted onto said cushion-receiving side arm and back support structures, padding material covering all of the upper side of said seat pan and extending underneath thereof except for a limited area on the underside of said seat pan to which said seat pan support structure is secured, and upholstery material removably covering all of said padding material on both the upper and lower sides of said seat pan and being positioned about said side arm and back support structures, said upholstery material being formed with flaps releasably joined together on the underside of said seat pan and also releasably secured to the underside of said seat pan along an edge portion of said limited area of said seat pan all to secure said upholstery material and padding on said seat pan.

6. A finished chair comprising a frame having a seat pan and a pair of upwardly extending cushion-receiving side arm structures and an upwardly extending cushion-receiving back support structure and a seat pan support structure, a plurality of cushion members removably fitted onto said cushion-receiving side arm and back support structures, each of said cushion members comprising a resilient padding member in the general shape of a bag open at one of its ends and closed at its opposite end, upholstery covering said padding member and also in the general shape of a bag open at one of its ends and closed at its opposite end and closed along its sides, said upholstery enclosing said padding member with the open end of each adjacent each other and the open end of said upholstery extending inside the open end of said padding member, first attaching means along an inwardly exposed under surface of said upholstery at the open end thereof, second attaching means along an inside surface of said padding member at the open end thereof and removably attached to said first attaching means to provide an upholstery cushion in the general shape of a padded bag open at one of its ends and closed at its opposite end and closed along its sides and in which the upholstery may be readily removed, the open end of each upholstered cushion member being placed over the associated one of said side arm and back support structures, padding material covering all of the upper side of said seat pan and extending underneath thereof except for a limited area on the underside of said seat pan to which said seat pan support structure is secured, and upholstery material removably covering all of said padding material on both the upper and lower sides of said seat pan, said upholstery material being formed with flaps releasably joined together on the underside of said seat pan and also releasably secured to the underside of said seat pan along an edge portion of said limited area of said seat pan all to secure said upholstery material and padding on said seat pan.

7. A finished chair according to claim 6, in which said first and second attaching means comprise male and female hook and loop type fasteners secured one to said padding member and the other to said upholstery along the open end of each.

* * * * *